US007375313B2

(12) United States Patent
Lee et al.

(10) Patent No.: US 7,375,313 B2
(45) Date of Patent: May 20, 2008

(54) AIMABLE MOTION-ACTIVATED LIGHTING FIXTURE WITH ANGULATED FIELD

(75) Inventors: Wade Lee, Danville, CA (US); Donald R. Sandell, San Jose, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 10/724,441

(22) Filed: Nov. 29, 2003

(65) Prior Publication Data

US 2005/0116171 A1 Jun. 2, 2005

(51) Int. Cl.

| | |
|---|---|
| ***G06M 7/00*** | (2006.01) |
| ***H01J 5/02*** | (2006.01) |
| ***G08B 13/18*** | (2006.01) |
| ***F21V 23/04*** | (2006.01) |

(52) U.S. Cl. ..... 250/221; 250/239; 340/567; 362/276

(58) Field of Classification Search ..... 250/239, 250/222.1, 221, 339.02, 339.01, 338, 353, 250/338.1, 340, 214 AL, 551; 362/276, 362/394, 421; 340/567, 555, 557, 556
See application file for complete search history.

(56) References Cited

U.S. PATENT DOCUMENTS

| | | | |
|---|---|---|---|
| 4,752,769 A | 6/1988 | Knaup et al. | |
| 4,757,204 A | 7/1988 | Baldwin et al. | |
| 4,841,284 A | 6/1989 | Biersdorff | 340/567 |

(Continued)

OTHER PUBLICATIONS

"CM 0.77 GI VX," Fresnel Technologies Inc. [online] (1995-2000) [retrieved prior to Nov. 2003] Retrieved from the internet, URL: http://www.fresneltech.com/pdf/CMO.77GIVX.pdf.

(Continued)

*Primary Examiner*—Georgia Y. Epps
*Assistant Examiner*—Don Williams
(74) *Attorney, Agent, or Firm*—Elliot B. Aronson

(57) ABSTRACT

A motion-activated light fixture having an aimable motion detector with a zonal configuration providing improved monitoring of the region behind the motion detector. In one embodiment the motion detector defines a first plurality of generally forward-looking detection zones for monitoring the region in front of and to the sides of the motion detector, the forward-looking detection zones having a side-to-side coverage angle of at most 180 degrees and having forward zones for monitoring the far region in front of the motion detector. A second plurality of detection zones for monitoring the region behind the motion detector forms a zonal pattern angulated with respect to the zones of the first plurality monitoring the far region. At least some of the detection zones of the second plurality extend generally in the backward direction although in some embodiments the motion detector head must be tilted down through a pre-established offset angle before the angulated zonal pattern begins to look backward. The motion detector may also have other detection zones forming zonal patterns monitoring intermediate regions. The backward looking detection zones are defined so as to look sufficiently downward that the amount they are shifted to angle upwards as the motion detector housing is angled downward is limited to a useful range so that individual detection zones are not rendered useless or detrimental by being aimed too high. Configurations of zonal patterns are provided for improved monitoring of the region behind the motion detector without compromising the ability to aim the motion detector's forward-looking far zones.

27 Claims, 7 Drawing Sheets

U.S. PATENT DOCUMENTS

| | | | | |
|---|---|---|---|---|
| 4,873,469 | A | 10/1989 | Young et al. | |
| 5,066,855 | A | 11/1991 | Lee | |
| 5,381,323 | A | 1/1995 | Osteen et al. | |
| 5,393,978 | A * | 2/1995 | Schwarz | 250/353 |
| 5,649,761 | A * | 7/1997 | Sandell et al. | 362/276 |
| 5,662,411 | A | 9/1997 | Haslam et al. | |
| 5,677,529 | A | 10/1997 | Hofmann et al. | |
| 5,818,337 | A * | 10/1998 | Erismann | 340/567 |
| 6,175,309 | B1 | 1/2001 | Drake et al. | |
| 6,215,399 | B1 * | 4/2001 | Shpater | 340/567 |
| 2003/0080296 | A1 | 5/2003 | Raper et al. | |

OTHER PUBLICATIONS

"Various PIR Arrays," Fresnel Technologies Inc. [online] (1991-2000) [retrieved prior to Nov. 2003] Retrieved from the internet, URL: http://www.fresneltech.com/pdf/variousArrays.pdf.

* cited by examiner

AIMABLE MOTION-ACTIVATED LIGHTING FIXTURE WITH ANGULATED FIELD

BACKGROUND OF THE INVENTION

The present invention relates to passive infra-red (PIR) motion detectors of the type used in outdoor lighting fixtures to illuminate an area such as a walkway or driveway when a person or automobile approaches. The invention is more particularly directed to the zonal pattern for covering the monitored field of view.

Outdoor motion-activated lighting fixtures are found in widespread use to monitor and illuminate areas around houses and other buildings such as walkways, driveways, garden areas, gateways and other areas subject to pedestrian traffic. One form of motion-activated fixture includes a floodlight, or frequently a pair of floodlights, and a motion detector housing supported on a common base plate that is mounted to a wall of a building or other structure. The floodlights and motion detector housing are each movably mounted to the base plate so that the lights and the motion detector can each be aimed at a desired target area. See for example U.S. Pat. No. 5,381,323.

The motion detector operates by creating a number of narrow detection zones extending out from the motion detector housing in different directions in the field of view. The detection zones may be envisioned as sensitive fingers stretching out from the motion detector housing into the field of view. See FIGS. 1, 2A and 2B for examples of detection zones. Infra-red energy emanating from a source located within an individual finger-like detection zone is directed onto a sensor in the motion detector housing while infra-red energy from regions between detection zones is not directed to the sensor. The sensor responds only when the infra-red energy impinging upon it changes, and the energy impinging upon the sensor will change whenever a person enters or leaves a detection zone. Thus, the pattern of detection zones determines to a great extent the size and shape of the region monitored by the motion detector and the coarseness or fineness with which the region is monitored.

Known motion detectors provide a number of different detection zone patterns. The zonal patterns generally include a group of detection zones, sometimes called the "far" zones, that is spread out from side to side over some angular width and that looks out to the far reaches of the monitored region. (See for example FIG. 2A.) Some zonal patterns provide coverage at more than one level by defining several groups of detection zones aimed downward by different amounts. The group of far zones is angled downward the least so as to look out at the farthest regions, and one or more other groups of zones are angled downward by greater amounts to look at closer-in regions. Some have so-called wide-angle coverage, meaning that they monitor an area with side-to-side angular spread upwards of 140 degrees.

Recently motion detectors for floodlight fixtures have become available that provide more than 180 degrees of side-to-side coverage. That means the motion detector looks backward to some extent—in effect, it looks over its shoulder—to detect a person approaching from behind. This is useful, for example, when the light fixture is mounted on a wall near a doorway. The motion detector extends out from the wall so that the doorway is set back somewhat behind the motion detector. The motion detector is primarily aimed to monitor the area out in front of the doorway, but with more than 180 degrees of coverage the motion detector can detect a person coming out through the door and turn on the light in response.

In the typical dual-flood fixture the motion detector housing is movably mounted so that it can be aimed up and down and side to side. This enables the housing to be turned so as to improve the coverage of the particular target area for any given installation. When the motion detector housing is tilted only slightly downward, the far zones look out into the distance more to cover a deeper area, thus increasing the range. As the housing is tilted down through a greater angle, the far zones look down more and cover a shorter range. As the motion detector housing is moved, however, the entire zonal pattern is shifted. Aiming the motion detector housing more downward to shorten the forward-looking range will cause any close-in detection zones to be shifted even closer in and will cause any backward-looking zones to be shifted upward to look farther back and possibly even skyward. The result is a compromise in the motion detector's coverage and performance.

SUMMARY OF THE INVENTION

The present invention provides a motion-activated light fixture having an aimable motion detector with a zonal configuration providing improved performance. Briefly, the motion detector defines a first plurality of generally forward-looking detection zones for monitoring the far reaches of the monitored area that have a side-to-side coverage angle of at most about 180 degrees. That is to say, the detection zones are substantially confined to the forward-looking direction. A second plurality of detection zones forms a zonal pattern angulated with respect to the far-region zonal pattern to extend in the downward direction with at least some of the detection zones of the second plurality extending also in the backward direction, or at least offset forward somewhat so that zones of the second plurality will extend backward when the far-zones are angled downward slightly. The motion detector may also have other detection zones forming zonal patterns monitoring intermediate regions, but all of the backward looking detection zones are defined so as to look sufficiently downward that the amount they are shifted to angle upwards as the motion detector housing is angled downward is limited to a useful range so that individual detection zones are not rendered useless or detrimental by being aimed too high.

It is an object of the invention to provide an aimable motion detector that addresses environmental sources of false activations that have generally been encountered when motion detectors have been used outdoors in the past. In particular, when prior art motion detectors having greater than 180 degrees of coverage are aimed downward, the backward-looking detection zones can be turned to aim upward and in some cases can even be aimed to look above the horizontal. It has not generally been appreciated that these backward and upward-looking detection zones can be a significant source of false activations from localized temperature fluctuations and slowly moving thermal disturbances. The present invention provides limitations on the backward zones to diminish if not overcome these effects. Configurations of zonal patterns are provided for improved monitoring of the region behind the motion detector without compromising the ability to aim the motion detector's forward-looking far zones.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
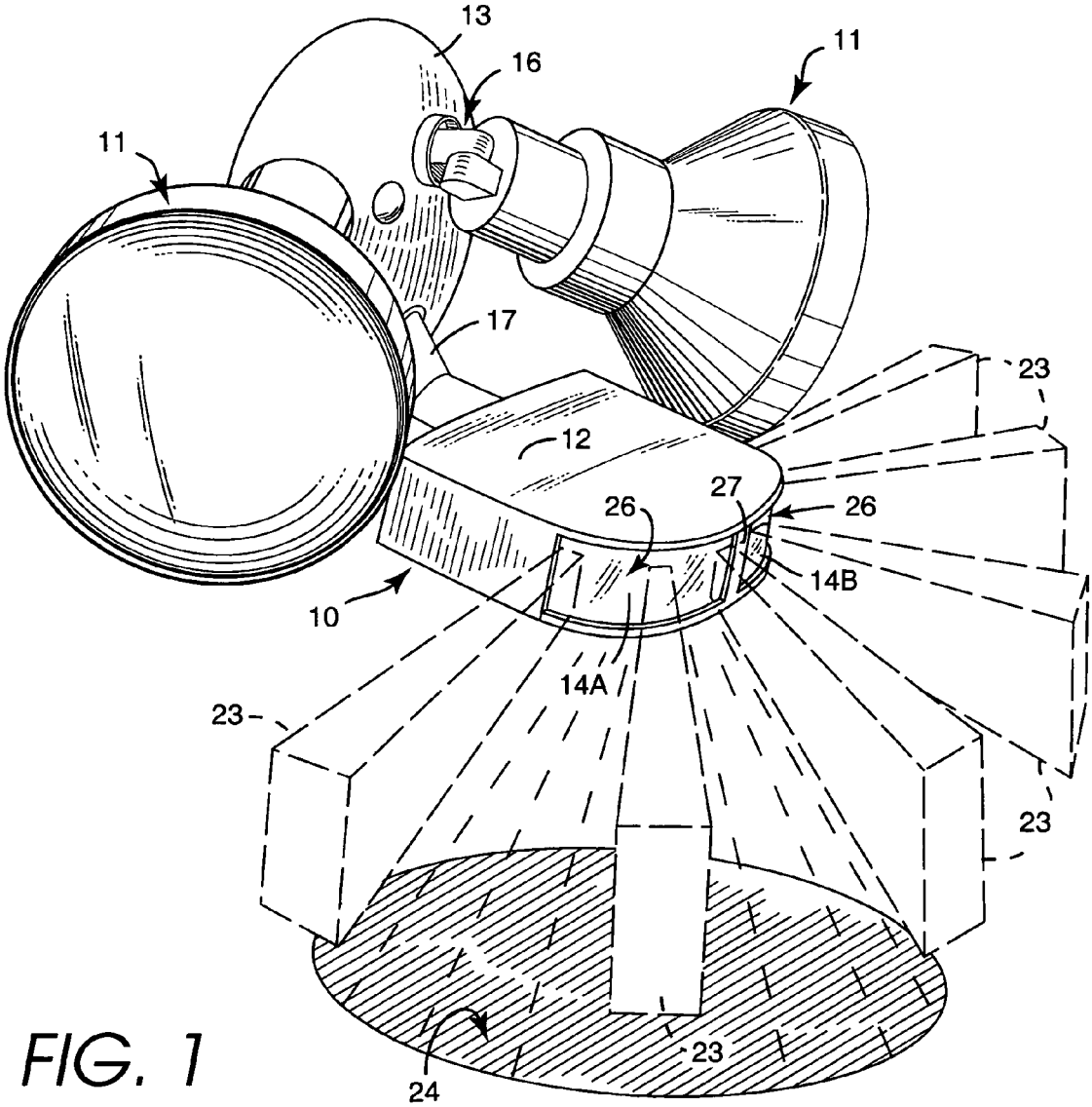
FIG. 1 is an overall view of a motion-activated dual-flood lighting fixture showing monitored fields of view in accord with the invention.

FIG. 1 illustrates an embodiment of a motion-activated dual-flood lighting fixture including a motion detector 10 and a pair of floodlights 11. The motion detector comprises a housing 12, sometimes referred to as the motion detector "head," which contains electrical and optical components for receiving and processing infra-red energy. The motion detector and floodlights are mounted on a common base plate 13. The motion detector includes a lens arrangement that looks out over the region to be monitored. The lens arrangement here is composed of two sections 14A and 14B and a downward-looking lens member 15 (visible in FIG. 3A). A feature of this type of lighting fixture is that the floodlights are movably mounted to the base plate (as through pivot connection 16) so that they can be aimed in desired directions and that the motion detector is also movably mounted to the base plate (as through supporting elbow connector 17) so that it can also be aimed in a desired direction.

A variety of mechanisms have been employed in the art for movably mounting a motion detector on a base plate so that the motion detector can be aimed. For example, the motion detector is often connected at its back end to the base plate through a ball joint permitting the unit to be moved in a range of directions pivoting about the ball joint. Some units use other types of swivel joints permitting a range of movements. Some units employ modified ball joints or modified universal joints that restrict movement to limited ranges. Sometimes the motion detector is connected to the joint through a short rigid connector, sometimes through a longer extension arm, and sometimes through an articulated arm. All of these mechanisms have in common that they permit the motion detector housing to be tilted to point up and down at the user's discretion and usually to point side to side as well. It is this movement that is at the root of the problem addressed herein. The specific form of movable mounting for the motion detector housing is not important to the invention so long as it allows the motion detector to be tilted at least in the vertical plane for aiming the field of view further away or closer in as the motion detector housing is tilted upward and downward.

Figure 2A:
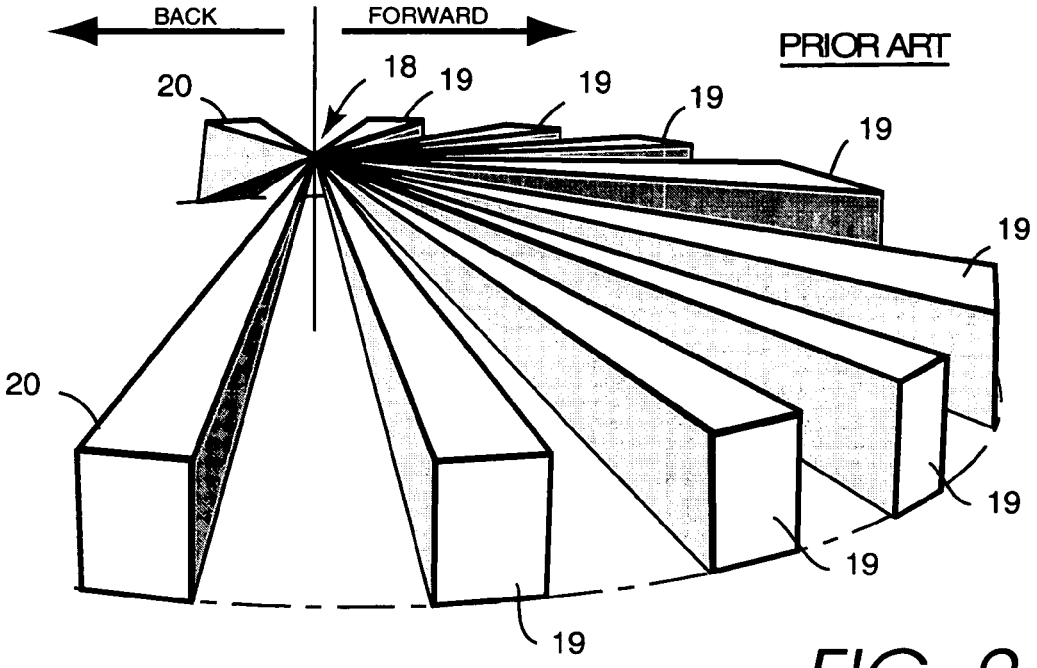
FIG. 2A is a diagrammatic perspective view of a prior art pattern of detection zones with the motion detector aimed straight ahead.

Before describing the improvements in the motion-activated lighting fixture afforded by the invention, it is beneficial to describe in more detail the nature of the problem that the invention addresses. As indicated above, a PIR motion detector operates by sensing changes in infra-red energy from the monitored region. To facilitate a change as a person moves within the region, the motion detector defines a plurality of sensitive detection zones interspersed with dead zones. As a person moves between a detection zone and a neighboring dead zone, there will be a change in the infra-red energy directed from the detection zone to the motion detector. FIG. 2A shows a typical array of detection zones as provided by a prior art motion detector positioned at the center 18 of the zonal pattern and having a field of view of greater than 180 degrees. For simplicity of illustration the motion detector itself has been omitted from FIG. 2A. The forward direction is to the right in FIG. 2A. The forward detection zones are indicated by reference numeral 19 and the backward zones by reference numeral 20. In any given prior art motion detector the number of zones and their size and angular distribution will generally differ from that of FIG. 2A, which is offered here only as a simple example illustrating the problem.

Figure 2B:
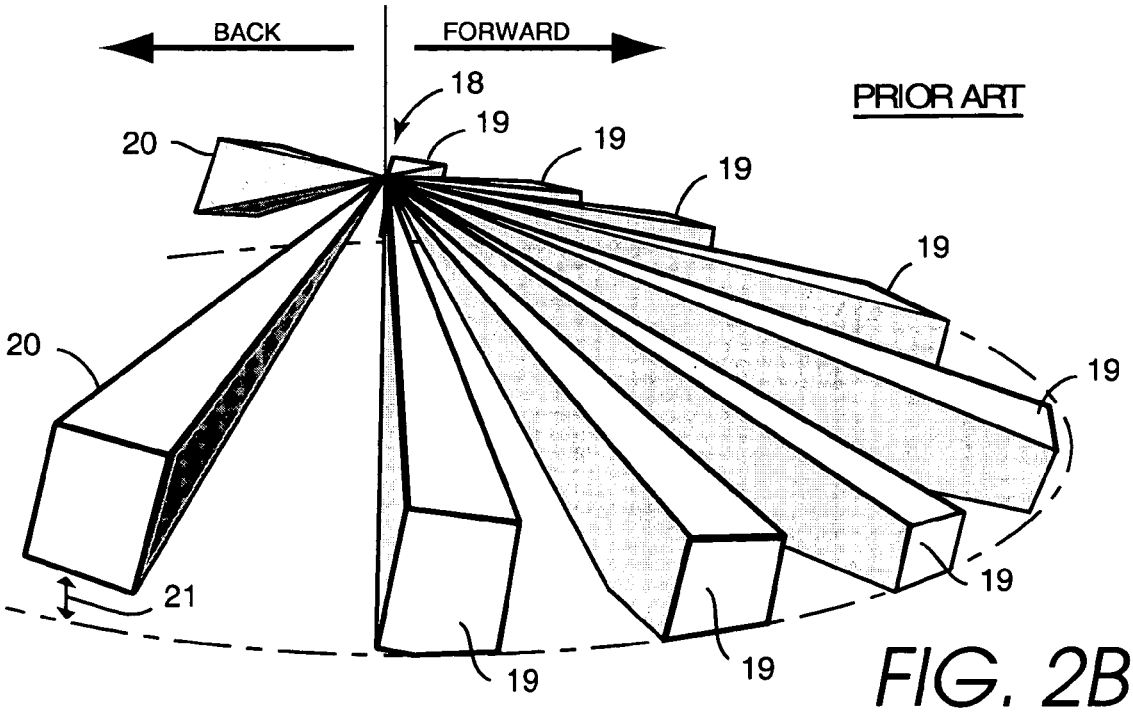
FIG. 2B is a diagrammatic perspective view of the prior art pattern of detection zones of FIG. 2A with the motion detector angled downward.

When the motion detector housing at center position 18 is tilted downward, the whole zonal pattern shifts as shown in FIG. 2B. Forward-looking zones 19 generally become angled more downward, and backward-looking zones 20 generally become angled more upward and further back. The forward zones that look generally straight-ahead (to the right in FIG. 2B) strike the ground sooner, so that the downward tilt has the desired effect of reducing the effective distance—sometimes referred to as the range—monitored by the motion detector. The range reduction is smaller for the more lateral forward zones, and decreases as the zone looks more and more laterally. For the backward-looking zones, however, the effect of the tilt is the opposite. The backward zones are raised up, and the range of these zones may actually increase. In fact, in many instances the backward-looking zones could be tilted upward sufficiently to look skyward. The more lateral of the downwardly angled forward zones near the boundary between forward and back can be swept back to become backward zones as the head is tilted downward, and any further downward tilt of the head then causes those zones to look further back and up.

A significant upward tilt in the backward-looking zones is undesirable because it can reduce the effectiveness in detecting motion and because it can lead to false activations. The effectiveness can be reduced because a gap can be created beneath the lower boundary of the zone such as illustrated at 21 in FIG. 2B or an existing gap may be substantially heightened. The gap constitutes a dead zone. Infra-red energy emanating from the gap will not be sensed by the motion detector, and that means in particular that infra-red energy from a desired target moving in the gap will have no effect. As a result, even for a small gap the zone will fail to see at least the lower portion of a person walking into (or out of) the detection zone, and for a large gap the zone could entirely miss a person walking in the area intended to be covered. If the zone fails to cover the lower portion of the target, the motion detector will receive only a fraction of the infra-red energy it might otherwise have received from the intended target, and the sensor will produce a weaker signal in response, which may be interpreted as noise falling below the threshold for activating the light. Thus, the mere presence of a gap, no matter whether it is large or small, leads at least to reduced signal strength and possibly even to no signal at all from intended targets, and this reduces the effectiveness in detecting a person walking in the area intended to be covered by the backward-looking zone.

The other problem of detection zones aimed too high is false activation. False activation refers to activation of the light in response to an infra-red energy change caused by something other than movement of an intended target. Outdoor PIR motion detectors are susceptible to false activations in particular from environmental factors that are not generally present indoors or in other controlled environments. Localized thermal imbalances and gentle air disturbances can produce localized transport of infra-red energy that is imperceptible or nearly imperceptible to casual human sensation, yet that may traverse the boundary of a detection zone and trigger a false activation. A skyward zone can look out at a piece of the sky for the full depth of the zone and is especially vulnerable to such environmental irregularities.

The present invention recognizes the shortcomings of the conventional zone distribution in movably mounted, aimable motion detectors as illustrated by FIGS. 2A and 2B and provides a new arrangement of zones that substantially eliminates troublesome upward-looking zones without sacrificing beneficial backward-looking zones and without compromising the ability to aim the motion detector over a practical range. To achieve this, the motion detector is structured and arranged to define a first plurality of forward-looking detection zones for monitoring the far field and a second plurality of downward and backward-looking detection zones, which are angulated with respect to the far-field zones and having restricted backward orientation as set out below for monitoring the field behind the motion detector. The first plurality corresponds to conventional far zones found in many prior art motion detectors except that here the plurality of far zones is devoid of zones monitoring backward directions to any significant degree. In the embodiment of FIG. 1 the far zones comprising the first group are depicted by the regions 23. For clarity of illustration only six representative far zones are shown. As will be appreciated by those skilled in the art, the far zones will generally include a larger number of zones. Because the far zones look out at the highest level of vision to achieve the farthest range, they are necessarily the zones angled down the least, if at all, when the motion detector head is in its level position, and thus any zones at the far zone level of vision looking backward to any significant degree are susceptible to being angled skyward as the head is tilted downward. That is, zones looking backward at roughly the level of vision of the forward far zones are the most problematic for both mis-aiming and generating false activations. It is desired to eliminate such zones from the uppermost level of vision.

In addition to straight-ahead and lateral-looking zones, the motion detector also defines a plurality of backward-directed zones, which are limited in the directions in which they look back. The limitation on the backward-looking zones is such that as the motion detector head is tilted throughout a useful range of forward directions for aiming the forward-directed far zones, the backward zones will not be shifted so much as to look skyward and will generally be shifted within their useful range.

In addition to the backward zones and the (forward and lateral-looking) far zones, the motion detector may also define other zones that look forward and more downward than the far zones to monitor mid-range and near-range forward regions. In the embodiment of FIG. 1 backward-directed zones and near-range forward-directed zones taken together monitor a conical region 24 beneath the motion detector. Again for clarity of illustration the individual zones are not delineated in FIG. 1. The backward-looking zones in region 24 are in a sufficiently downward-angulated relation with the far zones that, as the motion detector head 10 is tilted downward, the zones taken as a whole will not be shifted out of an effective range or be shifted skyward, which would increase false activations. Although the zones will generally tilt upward and somewhat further back as motion detector head 10 is tilted downward, the downward orientation of these zones relative to the straight-ahead far zones is steep enough that these zones will remain downward-looking as the head is tilted further downward throughout a useful range for aiming the far zones at a range of positions closer and farther away.

In the embodiment of FIG. 1 the far zones and the backward-looking zones are directed through windows of two separate orientations in the motion detector housing. The zones of the far group pass through first window apertures 26, which look out generally horizontally with respect to the housing and are generally referred to as the forward-looking window. The downward zones covering the region 24 pass through a second window (not visible in FIG. 1), which looks down generally vertically with respect to the housing and is generally referred to as the downward-looking window. Although a window may be referred to here in the singular, such as "forward-looking window," the motion detector may be configured with more than one such window aperture, and use of the singular is not intended to imply limitation to a single window aperture unless expressly indicated otherwise. For example, in FIG. 1 the two window apertures 26 are separated by a vertical rib or partition 27. The lens member may be directly mounted in the window such as illustrated in FIG. 1, but this is not necessary for practice of the invention. In other embodiments one or more lens members may be mounted behind the window and the aperture may be open or covered with a transparent or translucent cover. In yet other embodiments mirror arrangements or other optical devices may be included behind the window and used instead of or in combination with focusing lenses for defining an optical path that directs and concentrates infra-red energy passing through the window onto one or more sensors.

The important characteristics for this aspect of the invention are that the window allow infra-red energy of appropriate wavelengths to pass through and that the forward-looking window be oriented at least so as to permit optical paths for the far zones that are generally forward-looking and the downward-looking window be oriented at least so as to permit optical paths for the backward zones that are generally downward-looking, angulated with respect to the forward-looking far zones. Thus, while the forward-looking window will typically by oriented vertically with respect to the housing and the downward-looking window will typically be oriented horizontally at the underside of the housing, departure from these orientations may be desired, for example, for reasons of stylistic design.

Figure 3A:
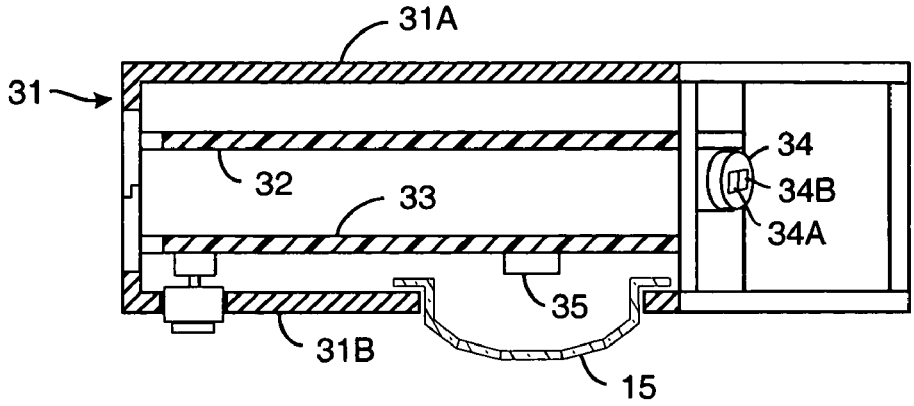
FIG. 3A is a cross-sectional view, partially in elevation, showing a motion detector as in FIG. 1.

The embodiment of FIG. 1 is now described in more detail with reference to FIGS. 3A and 31B. A motion detector housing 31 includes a top housing member 31A and a bottom housing member 31B. Upper and lower printed circuit boards 32 and 33, respectively, are mounted within the housing. Mounted on the upper printed circuit board are two infra-red sensor chips 34 facing generally forward but angled somewhat toward opposite sides. Mounted on lower printed circuit board 33 is a downward facing infra-red sensor chip 35. The sensor chips are of the type having a pair of side-by-side sensing elements 34A and 34B, which define separate adjacent subzones. A lens retainer and mask member 37 is positioned in front of the forward-looking sensors 34 and defines a pair of forward-looking windows through openings 38. Each of the sensors 34 looks through one of the windows 38 and is masked from any infra-red energy entering through the opposite window by the walls of the member 37. Mounted on the front of each window is a segmented Fresnel lens member 39 including a plurality of individual Fresnel lenslets for concentrating infra-red energy from the respective detection zones onto one of the sensors 34. Bottom housing member 31B defines a downward-looking window through opening 41. Mounted within opening 41 is another segmented Fresnel lens member 15, which defines a second plurality of detection zones, which are downward-looking and at least some of which also look backwards. In this embodiment lens 15 monitors a generally conically shaped region of the general form illustrated in FIG. 1 at 24.

Figure 3B:
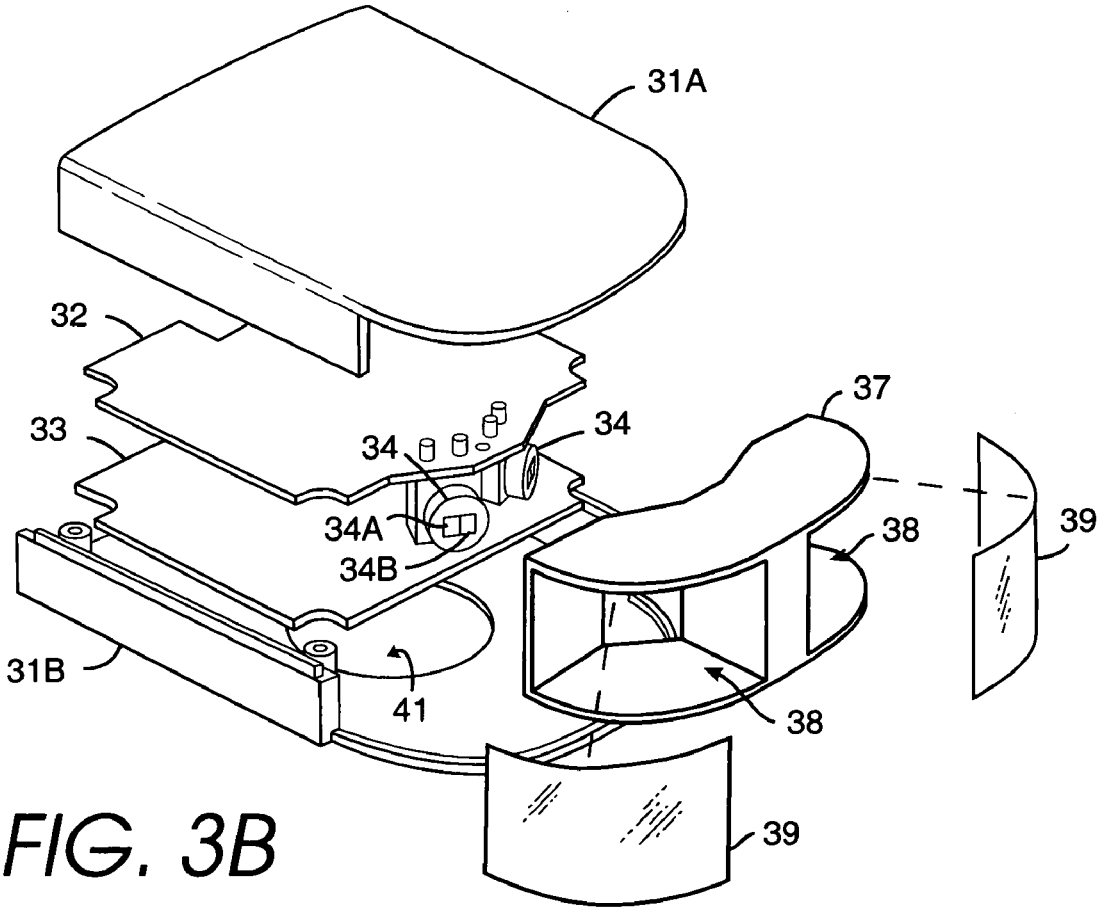
FIG. 3B is an exploded view of the motion detector of FIG. 3A.

Segmented Fresnel lenses and infra-red sensor chips for use with PIR motion detectors are commercially available and their structure and operation are well known and thus need not be described in detail here. The forward-looking Fresnel lens members 39 define the far zones and may also include one or more additional tiers of lenslets defining other levels of vision for monitoring intermediate ranges. Lens members 39 may generally also include lenslets defining lateral zones looking out perpendicular or almost perpendicular to the straight-ahead forward direction. In the embodiment of FIGS. 3A and 3B lenses 39 do not define any zones that look backward to any significant degree, although a perpendicular laterally looking zone can extend into the back region to an insubstantial degree without negating the benefits of the invention, as will be seen in more detail below.

Figure 4A:
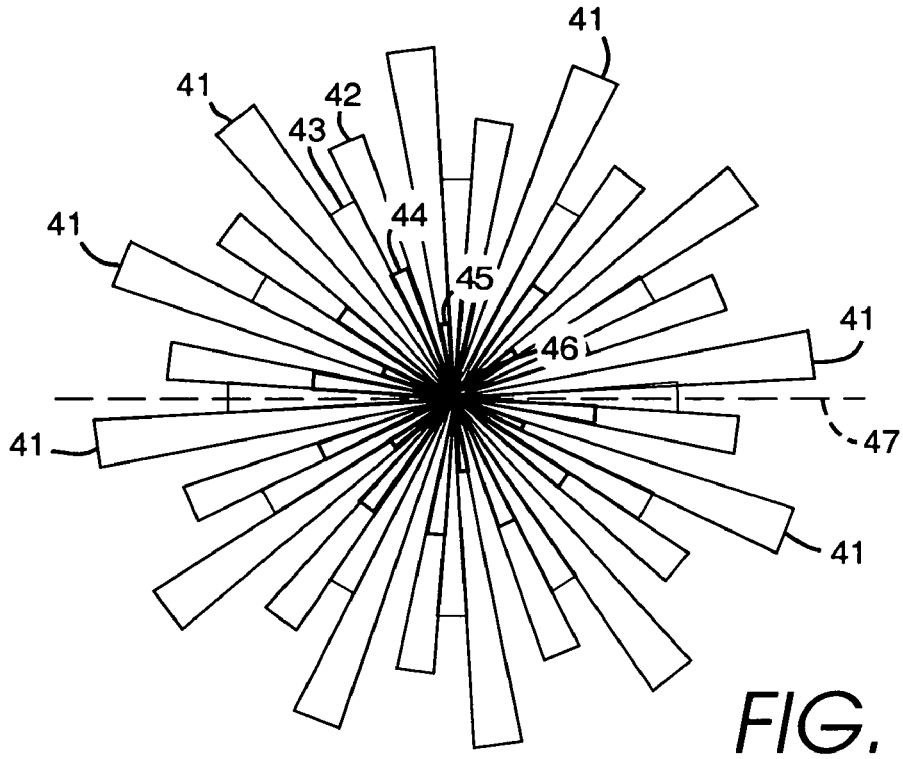
FIGS. 4A and 4B are top and side views, respectively, of a downward-looking zonal pattern, for use for example in the embodiment of FIG. 1.
Figure 4B:
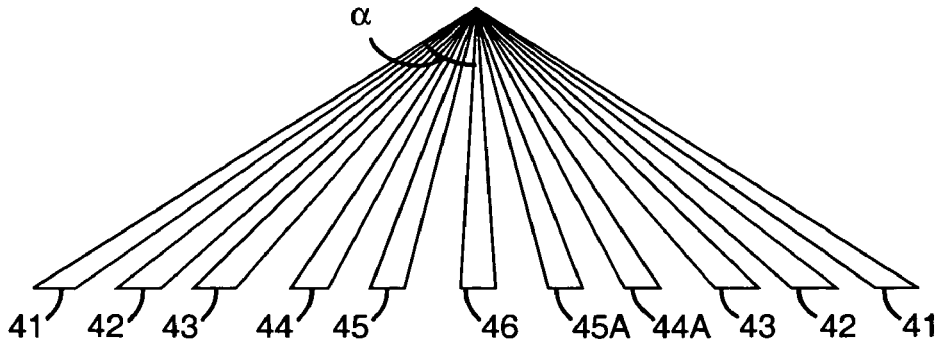

The downward-looking Fresnel lens member 15 in this embodiment defines a generally conical array of detection zones. FIGS. 4A and 4B show a representative conical zonal pattern. The lens defines six levels of vision 41-46. For the conical pattern the "levels" of vision are perhaps better pictured as "circles" of vision. In FIGS. 4A and 4B zones of the same level are labeled by the same reference numeral. The sixth level 46 looks straight down the axis of the cone, that is, it looks straight down under the motion detector head when the head is horizontal. FIG. 4B shows a side elevational view of the pattern as if along the forward-back pattern centerline 47. The size of the cone is generally indicated by the angular spread of the cone, which is measured by the half-angle $\alpha$ between an outermost zone and the vertical. For the cone of FIG. 4B $\alpha$ is approximately equal to 56°.

It is generally desirable to have a dense pattern of zones formed by a number of zones at different levels of vision with some of the zones pointing in the forward and backward directions such as the pattern shown in FIGS. 4A and 4B. Downward-looking lenses with dense arrays of this sort are known from the security industry where they have been used in motion detectors for indoor burglar alarms that are mounted in fixed position on a ceiling for monitoring a room. The present invention recognizes that such arrays are also beneficial for outdoor aimable motion detectors to address the false activation and mis-aiming problems. When the motion detector head is tilted down to aim the forward-looking far zones from lenses 39, the conical pattern from lens 15 is rotated back approximately about the apex of the cone, and backward-directed zones are swept further back and up. But forward-directed conical zones will similarly be rotated and some will become backward zones and will take the place of those backward zones that are swept further back. This may be pictured with reference to the side view of FIG. 4B, in which the forward direction is to the right and the backward direction to the left. As the cone is rotated back about the apex (clockwise), first the straight-downward zone 46, then the forward zone 45A, then the forward zone 44A, and so on in sequence, become backward zones for monitoring the field behind the motion detector as other backward zones are shifted higher. In this way a wide-angle cone with many inner zones may advantageously be used for the downward looking zones. The cone angle may be selected such that the head may be tilted downward through a useful range for aiming the far zones, yet the backward-most zones will not be turned skyward thereby avoiding a significant environmental source of false activations. Yet as the backward-most zones are shifted further back and up—thereby generating a gap beneath them—close-in forward zones are shifted back effectively to cover the gap or at least cover an equivalent nearby region. A pattern with an average zone density of at least one level of vision for every twelve degrees of cone angle $\alpha$ such as shown in FIGS. 4A and 4B provides a good density of coverage.

Using separate optical arrangements for monitoring the far/intermediate regions (lens members 39) and the close-in regions (lens member 15) is advantageous in that different focal lengths more appropriate for the intended targets can readily be used for the two optical arrangements. Longer focal lengths are used for detecting motion at greater distances, and shorter focal lengths are used for close-in targets. As the target moves across a detection zone, the image focused on a sensor sweeps across the sensitive element of the sensor, and with a shorter focal length the image sweeps more slowly across the sensor. This is desirable to slow down the apparent motion of a close-in target. Using a focal length adapted for far-range targets may cause the image of a close-in target to sweep across the sensor too rapidly and produce a signal that will get filtered out to a great extent by the subsequent electronic circuitry, in effect, impairing detection of close-in targets. The separate optical arrangement, and in particular a separate single Fresnel lens member, for monitoring close-in regions allows one to separately tailor the optical geometries, that is, the lens-sensor relationships, for close-in detection and for far-range detection.

Figure 5:
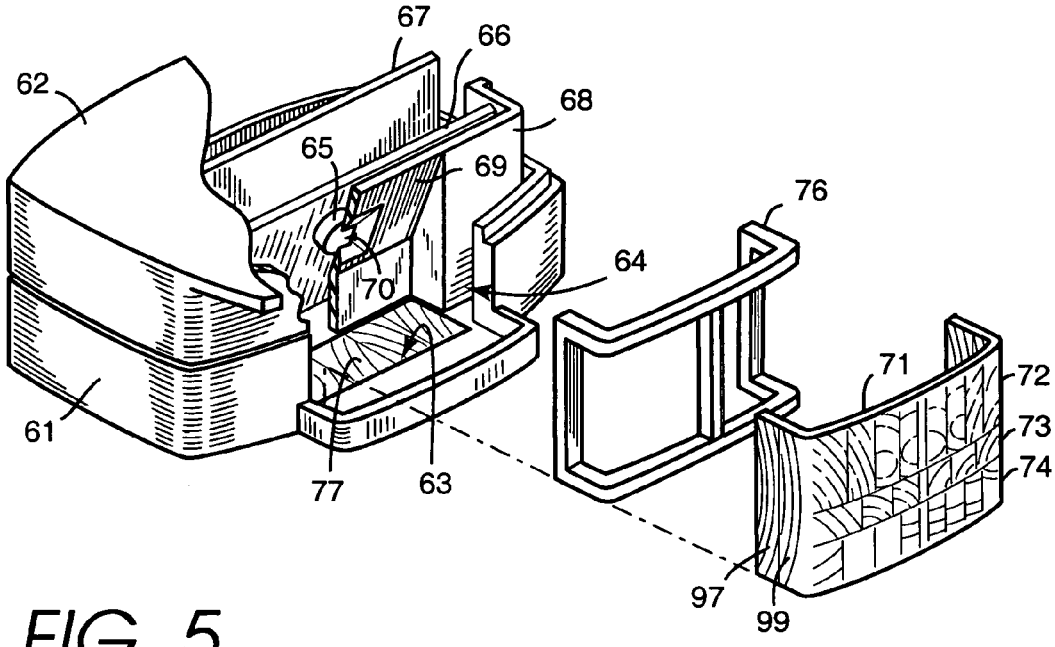
FIG. 5 is a perspective view, partially cutaway and exploded, showing another embodiment of motion detector in accord with the invention.

FIG. 5 shows another embodiment of a motion detector according to the invention, in which the pattern of detection zones is formed with only a single sensor chip. The motion detector housing is formed of a bottom housing member 61 and a top housing member 62, which has been cut away in FIG. 5 to reveal the insides of the motion detector. Bottom housing member 61 defines a downward-looking window 63, and housing members 61 and 62 taken together define a forward-looking window 64. The single sensor chip 65 is mounted on a first printed circuit board 66, which is angled forward somewhat so that sensor 65 looks both forward and downward with respect to the motion detector housing. A second printed circuit board 67 for the motion detector control circuitry is positioned behind the sensor board 66. In front of the sensor board 66 is a sensor mask member 68 that has an angled portion 69 sloped at the same angle as sensor chip 65. Angled portion 69 defines a sensor window 70 that overlies the sensing elements on the chip 65. A first segmented Fresnel lens member 71 defines a first plurality of detection zones that are arranged in several forward levels of vision. A representative pattern of Fresnel lenslets is shown on lens member 71. The lenslets 72 lying in the same row define the highest level of vision, which monitors the far region. The rows of lenslets 73 and 74 define intermediate levels of vision, which monitor near and intermediate mid-regions. Lens member 71 is held in position by lens frame member 76. A second segmented Fresnel lens member 77 defines another plurality of detection zones that look generally downward for monitoring a field behind the motion detector as well as a close-in region under the motion detector or somewhat forward.

Figure 6A:
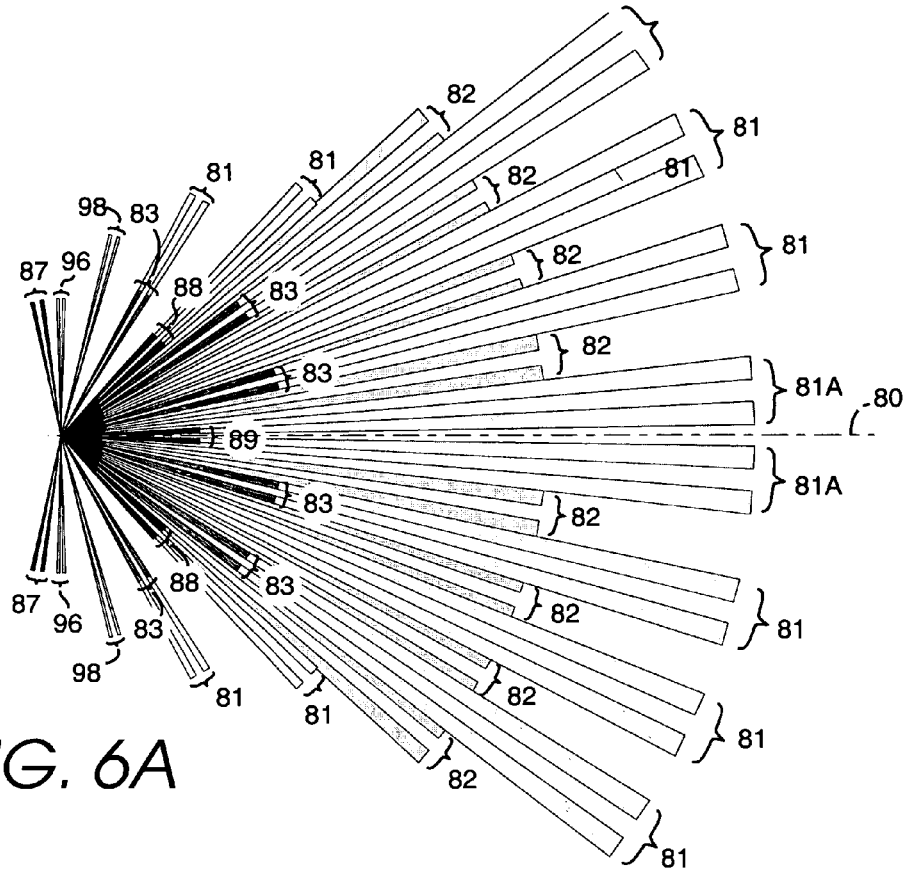
FIGS. 6A and 6B are top and side views, respectively, of combined forward and downward zonal patterns for use for example in the embodiment of FIG. 5.
Figure 6B:
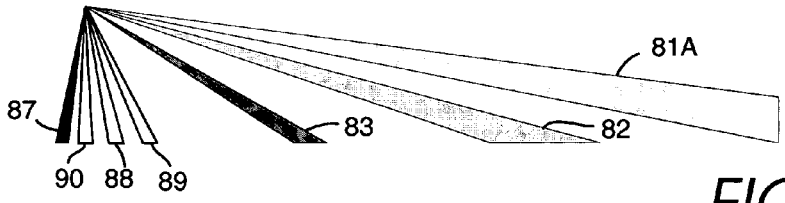

FIGS. 6A and 6B show a representative zonal pattern for the embodiment of FIG. 5. FIGS. 6A and 6B show the combined zonal pattern for forward-looking lens member 71 and downward-looking lens member 77. FIG. 6A is a plan view of the pattern, and FIG. 6B is a side view of representative zones on the same scale as FIG. 6A taken through the centerplane 80 of FIG. 6A and showing the forward or backward reach of representative downward-looking zones projected onto the centerplane. The far zones defined through forward-looking lens 71 are indicated by reference numeral 81, the intermediate mid-zones by reference numeral 82, and the near mid-zones by reference numeral 83. Zones in FIG. 6A shown grouped together in adjacent couplets are generated by the same lenslet and the two side-by-side sensor elements of sensor 63. The downward-looking lens 77 generates backward-looking zones 87, which are shown for purposes of illustration on the side view of FIG. 6B even through they do not lie on centerplane 80. Lens 77 also generates downward-looking zones 88, which are slightly forward-looking when the motion detector head is level and are also illustrated in FIG. 6B even through they do not lie on the centerplane. Downward-looking lens 77 with the pattern of FIGS. 6A and 6B also defines a forward-looking zone couplet 89 and a zone couplet 90 that looks approximately straight downward. As the motion detector head is rotated downward, the zones 87 are shifted further back and up, and the zones 90 and then 88 and then 89 are shifted to become backward-looking zones. Lens 77 may alternatively define a greater density of downward-looking zones to give greater coverage of the field behind the motion detector as the head is tilted downward through its angular reach. With a greater density of backward and forward downward-looking zones, more and more zones will be available to be shifted backward as the head is tilted. The downward-looking zones 87-90 form a flatter pattern—which may be referred to as a curtain pattern—than the conical pattern of FIGS. 4A and 4B. A curtain pattern permits the motion detector head to be tilted down through a greater angle before any of the backward-looking zones reach their skyward-looking limit. In general, a curtain pattern is distinguished by its footprint on the ground when the motion detector head is level. The footprint is the boundary of the monitored region on the ground covered by the downward-looking optics. The footprint will have a linearly extending shape dividing the forward and back directions. The curtain footprint will be generally narrower in the forward-back direction than it is wide in the side-to-side direction.

Figure 7:
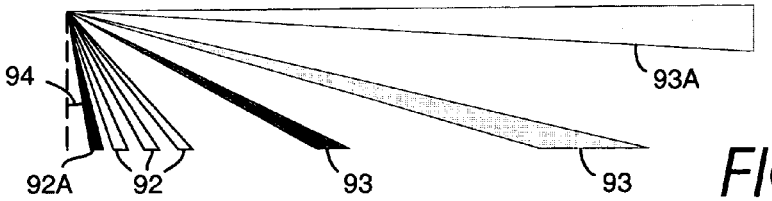
FIG. 7 is a side view of an alternative zonal pattern to FIG. 6B.

For the embodiment of FIGS. 6A and 6B the straight-ahead forward-looking far zones 81A are angled downward by approximately 14° when the head is level. In other embodiments the straight-ahead far zones may be approximately level with the motion detector head so that, as a practical matter, the head is intended to be tilted downward to some extent when in use. For such embodiments it is generally more effective for the downward-looking zones (those directed through the downward window) to be angled forward initially by a characteristic offset angle when the head is level. FIG. 7 illustrates such a zonal pattern. Zones 92 look through the downward window. Zones 93 look through the forward window. The far zone 93A is approximately horizontal when the motion detector head is level and the furthest back downward zone 92A is offset from the vertical by angle 94. The downward-looking zones will then be sequentially moved into backward-monitoring disposition when the far zone 93A is aimed downward through an angle at least as great as offset angle 94.

Figure 8:
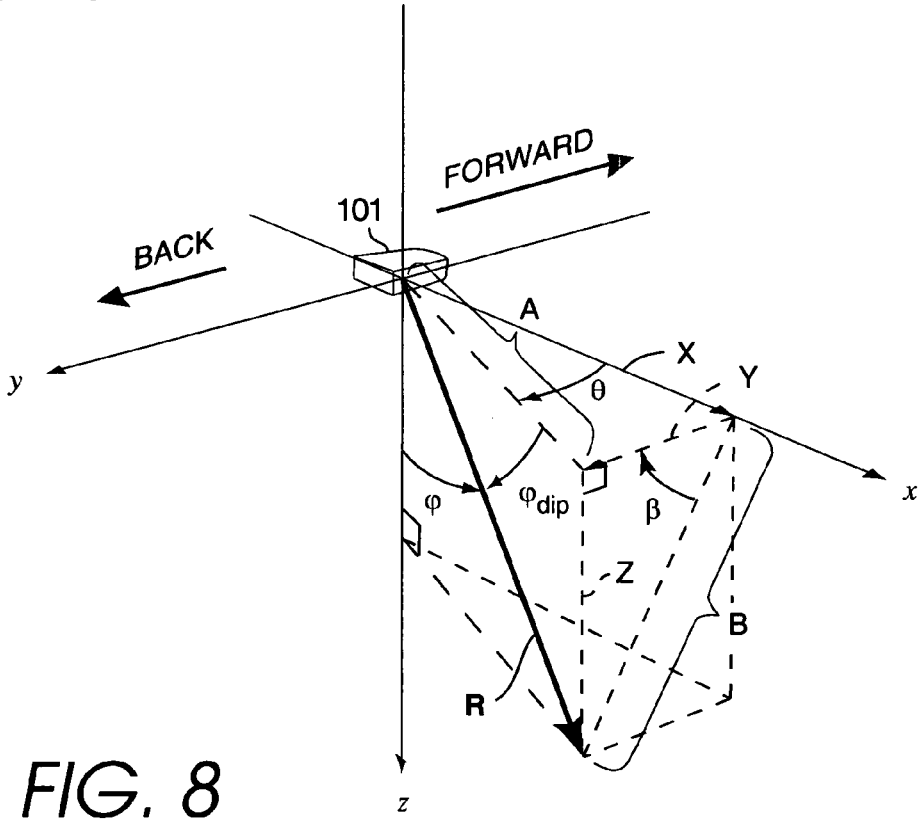
FIG. 8 is a diagrammatic view of a coordinate system used for analyzing the rotation of a detection zone.

Having described the angulated fields in general and given examples of specific embodiments for implementing the angulated fields, more detailed description is now given of the angular disposition of the backward zones as the motion detector head is tilted downward. FIG. 8 shows a representation of a single backward-looking zone, the direction of which is given by the direction vector R pointing in the direction of the zone. The position of direction vector R is given with respect to a coordinate system fixed in space with the origin at the motion detector head 101. More particularly, the origin is positioned at the point from which the detection zones appear to emanate. The z axis points vertically downward. The x axis is horizontal and demarcates the border between forward and back, and the y axis is hoxizontal and points backwards. In this coordinate system the direction of the vector R representing a detection zone is given in spherical coordinates by polar angle $\phi$ from the positive z axis and azimuth $\theta$ from the positive x axis in the xy plane. Let X, Y and Z be the components of R along the x, y and z axes, respectively, and let A and B be the lengths of the projections of R onto the xy and yz planes respectively.

Tilting motion detector head 101 vertically downward moves the head in the yz plane and is the same as rotating the head about the x axis. Rotating the head also rotates the direction vector R about the x axis (along with all the other detection zones) so that R becomes angled more upward ($\phi$ increases) and back ($\theta$ increases for $\theta$ between 0 and 90°). The x component of R remains fixed and the yz projection B, which is perpendicular to the x axis, rotates about the x axis. For purposes of the present discussion the head is assumed to rotate about the point from which the downward-looking zones appear to emanate. In most installations the head will move about the connection point at base member 13. Such movement, however, may be viewed as a rotation of the head about the point from which the downward-looking zones appear to emanate plus a small linear displacement. As a practical matter the small linear displacement does not have any significant effect on the results reached here.

Let $\beta$ be the angle through which the head must be tilted down, starting from a horizontal position, to make the direction vector R horizontal. That is, tilting the head any more downward beyond $\beta$ would cause the zone to point skyward. In FIG. 7 the angle $\beta$ is the angle through which the projection B has to be rotated to bring it into the horizontal plane. The angle $\beta$ depends on $\theta$ and $\phi$ and will be different for different detection zones.

The relation among β, θ and ϕ may be obtained from the relation $$\frac{Z}{Y} = \frac{Z}{A} \cdot \frac{A}{Y}. \tag{1}$$

From FIG. 7 these ratios are seen to be related to the angles as follows:

$$\frac{Z}{Y} = \tan\beta,\ \frac{Z}{A} = \cot\varphi,\ \frac{Y}{A} = \sin\theta. \tag{2}$$

Substituting Eqs. (2) into (1) yields $$\tan\beta = \frac{\cot\varphi}{\sin\theta}. \tag{3}$$

It is sometimes more convenient to express this relation in terms of the dip angle $\phi_{dip}$ by which a zone's direction vector dips below the horizontal, $$\varphi_{dip} = \frac{\pi}{2} - \varphi, \text{ and} \tag{4}$$

$$\tan\beta = \frac{\tan\varphi_{dip}}{\sin\theta}. \tag{5}$$

In summary, a detection zone angled back by an angle θ and dipping below the horizontal by an angle $\phi_{dip}$ when the motion detector head is level will be turned skyward when the motion detector head is tilted down by more than the angle β given by Eq. (5).

In practice, motion detectors on flood light fixtures rarely need to be angled down by more than about 60° and in most installations usually by significantly less than 60°. Thus, a motion detector will be able to be used in substantially all practical mounting installations if it can be tilted downward by as much as 60° without any of the backward zones being turned skyward. This constraint will be achieved in the most general situation when every backward-looking zone of azimuth θ has a dip angle greater than or equal to the limiting dip angle $\phi_{limit}$ specified by Eq. (6):

$$\tan \phi_{limit} = \tan 60° \sin \theta = (1.732)\sin \theta. \tag{6}$$

A motion detector with backward-looking zones constrained in this way and aimably mounted in conjunction with an outdoor lighting fixture provides an all-purpose aimable motion-activated lighting fixture that can be mounted in the great majority of geometries met in practice and enjoy the benefits of the invention. Thus, with the constraints of Eq. (6) in effect, the motion detector may be installed not only on walls, but also on other support structures such as poles or columns that minimally obstruct backward detection zones. As will be discussed below, for installations on a wall where the wall will block a portion of the backward-looking zones, the above constraint may be relaxed.

For a motion detector having a downward looking zonal configuration in the form of a right circular cone, the condition of Eq. (6) corresponds to a cone half-angle of 30°. Other zonal configurations may also be used such as the curtain configuration mentioned above in connection with the embodiment of FIG. 5 or other cone shapes having ellipsoidal or other bases. For such alternatively shaped downward looking zones, the criterion of Eq. (6) is satisfied when each zone has a dip angle at the zone's azimuthal angle θ greater than that specified in Eq. (6).

The discussion is now turned to so-called 180° lateral zones that look out to the sides perpendicular or almost perpendicular to the straight-ahead forward direction. In accordance with the invention the zonal pattern of far zones through the forward window monitors the region in front of, but not behind the motion detector. In some configurations the forward zonal pattern of far zones may have a full 180° field of view stretching from side to side. It does not interfere with or diminish the benefits of the invention if the extreme lateral zones of such a pattern—those perpendicular to the forward direction—extend over a small amount into the backward direction. Such zones do not monitor the region behind the motion detector to any significant degree and will not be rotated to extend skyward in practical installations. In the zonal pattern of FIG. 6A the zone couplet 96 extends perpendicular to the horizontal centerline of the pattern, that is, it extends in the xz plane dividing forward from back. The zone couplet 96 is generated by the lenslet 97 shown in FIG. 5 at the lateral edge of the forward-looking window. The zone couplet 98 generated by lenslet 99 is a less extreme example. These zones are necessarily angled down to look at the ground. The amount of the downward dip angle with respect to the motion detector head will vary from embodiment to embodiment. As indicated above, a zone couplet, such as the couplets 96 and 98, includes two subzones, which are generated by two side-by-side sensitive elements on the sensor chip (the elements 34A, 34B in FIGS. 3A and 3B, for example). One of the subzones of couplet 96 extends backwards slightly and the other extends forward equally slightly. Such a backward extension is merely incidental to the sideways zone and is not intended and does not function to monitor the region behind the motion detector to any significant degree. It may now be understood that these zones do not as a practical matter contribute to any significant extent to the problems addressed herein. Equation (5) implies the following. For an extreme lateral zone lying in the xz plane and pointed downward at any dip angle, the azimuth θ equals zero (or 180° for zones pointing to the opposite side), and the head must be rotated through a full 90°, i.e., turned all the way down, before such an extreme lateral zone would be turned skyward. For a zone such as one of the subzones of the couplet 96 extending back a small amount, say θ equals 5°, then even with a dip angle as small as 10° the head must be tilted by more than 60° before the subzone turns skyward, and as indicated above such a large tilt is usually not encountered in most practical installations. For a dip angle of 20°, which is still quite small in practice for an extreme lateral zone, and θ still set at 5°, Eq. (5) implies that the head must be tilted through more than 75° before the extreme lateral zone turns skyward. Thus, as a practical matter even if an extreme lateral zone looks backward a small amount, it does not look backward to a significant enough degree that it could be turned skyward as the head is tilted down through any practical range.

Attention is now turned to a motion detector mounted on or adjacent to a vertical wall and the effect of the wall on the backward zones and the constraint of Eq. (6). As the motion detector head is turned downward, and the backward-pointing zones are consequently turned upward, the wall will block at least some portion of the zones so that they will not see any significant section of the sky even if they may be turned to look above the horizontal. Such blocked zones will be significantly less susceptible to the false activation problem although they may still be subject to the mis-aiming problem. The presence of a nearby wall allows greater freedom in rotating the motion detector head, although there are still limits.

Assume that the downward-looking zones, at least sone of which look backward, form a right circular cone 105. (See FIG. 9.) Assume further that the motion detector head is disposed such that the central axis of cone 105 is vertical. The motion detector head is mounted on or at a vertical wall 106 and spaced a distance d apart from the wall. The same Cartesian coordinate system is used as in FIG. 7. The wall lies in a plane parallel to the xz plane. For all points on the wall, $$y=g. \tag{7}$$

Assume now that the motion detector is mounted near an end 107 of the wall; specifically, the motion detector is mounted a horizontal distance D from the vertical edge 107. Thus, the edge of the wall is characterized by those points for which $$x=D \text{ and } y=d. \tag{8}$$

Figure 9:
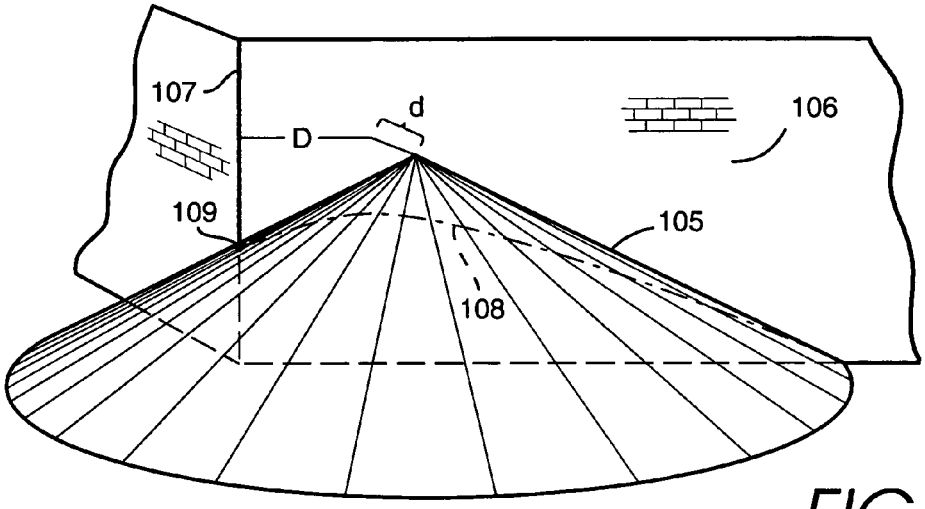
FIG. 9 is a diagrammatic view of a motion detector mounted on a wall.

For the sake of definiteness, it is assumed here that the edge of the wall is on the left when facing the wall and the wall extends to the right as in FIG. 9. If the edge were on the right with the wall extending to the left, the edge would have an x coordinate of −D. In spherical coordinates Eqs. (8) for the edge become $$\rho\sin\phi\cos\theta=D \text{ and } \rho\sin\phi\sin\theta=d \tag{9}$$

Dividing the first of Eqs. (9) by the second yields $$\cot\theta = \frac{D}{d} = p, \tag{10}$$

where the parameter p may be viewed as measuring the motion detector's horizontal spacing D in units of the motion detector's perpendicular spacing d from the wall.

The vertically oriented cone 105 of downward-looking detection zones is described in spherical coordinates by $$\phi=\alpha. \tag{11}$$

Cone 105 intersects the wall in curve 108, which meets edge 107 at intersection point 109. The point 109 acts as a kind of "break" point. Backward detection zones aimed to the right of point 109 will fall on the wall, and detection zones to the left of point 109 will "break away" from the wall and continue to monitor for motion beyond the wall.

The direction from the apex of the cone (which is at the origin of the coordinate system) to break point 109 is specified by the spherical coordinate angles $\phi$, $\theta$ given by Eqs. (10) and (11) since point 109 lies on both edge 107 and cone 105.

The angular direction to the break point 109 is used below to clarify the constraints on the backward-looking zones in the presence of a wall. For the sake of completeness, the z coordinate of intersection point 109 is also determined. The intersection of cone 105 and wall 106 is characterized by Eqs. (7) and (11), which may be combined to yield in spherical coordinates $$\rho \sin\alpha \sin\theta=d, \tag{12}$$

or squaring both sides, $$\rho^2 \sin^2\alpha \sin^2\theta=d^2. \tag{13}$$

The x and z coordinate values on the intersection are expressed in spherical coordinates by $$x=\rho \sin\alpha \cos\theta \text{ and } z=\rho \cos\alpha \tag{14}$$

Simplifying Eq. (13) using Eqs. (14) yields the equation for intersection curve 108:

$$z^2 \tan^2\alpha - x^2 = d^2. \tag{15}$$

The z coordinate of intersection point 109 with the edge of the wall is found when x is set equal to D:

$$z_{intersect} = \frac{d\sqrt{(1+p^2)}}{\tan a}. \tag{16}$$

In summary thus far, when the motion detector is mounted a perpendicular distance d from a wall and a horizontal distance D from the closest vertical edge of the wall, and the head is untilted so that the axis of the downward-looking right circular cone of detection zones is vertical, then the direction of a detection zone to the edge of the wall is given by the spherical coordinates ($\alpha$, $\theta_{intersect}$) where $\theta_{intersect}$ is determined from Eq. (10). A detection zone with an azimuthal angle $\theta$ greater than $\theta_{intersect}$ will be blocked by the wall, and a zone with an angle $\theta$ less than $\theta_{intersect}$ will miss the wall. In this description it has been assumed that the edge of the wall is to the left of the motion detector as seen when facing the wall. When the wall's edge is to the right of the motion detector, then p in Eq. (10) is negative and $\theta_{intersect}$ is between 90° and 180°. In this case also, $\theta_{intersect}$ defines the demarcation between those zones that are blocked by the wall and those that break clear of the wall. The first detection zone to clear the wall, that is, the detection zone with angular coordinates ($\alpha$, $\theta_{intersect}$), may sometimes be referred to as the break-away or breaking detection zone since it is the first detection zone to "break away" from the wall.

In the presence of a wall it is only necessary that the permissible downward tilting of the motion detector head be limited such that those zones that miss the wall will not be raised so much as to point skyward. Eq. (3) gives the general expression for the angle through which the head must be rotated to bring a zone in an initial direction $\phi$, $\theta$ to a horizontal position. Let $\beta_{wall}$ be the limiting angle through which the head may be rotated in the presence of a wall where the motion detector is mounted a horizontal distance p from the closest edge of the wall and a unit distance perpendicular to the wall. Then the angle $\beta_{wall}$ is determined by substituting the values of $\phi$ and $\theta$ from Eqs. (10) and (11) into Eq. (3):

$$\tan \beta_{wall}=\sqrt{(1+p^2)}\cdot\cot \alpha. \tag{17}$$

In summary, a motion detector is mounted at a wall spaced a unit distance from the wall and a horizontal distance p from the closest edge of the wall. A backward-looking detection zone aimed at the edge of the wall so as to just clear the wall has a polar angle $\alpha$ or equivalently a dip angle $\pi/2-\alpha$. This detection zone will be raised to look skyward when the motion detector head is tilted down by an angle greater than $\beta_{wall}$ given by Eq. (17). Stated differently, the head may be tilted down through an angle up to $\beta_{wall}$ without the break-away detection zone being turned skyward.

Figure 10:
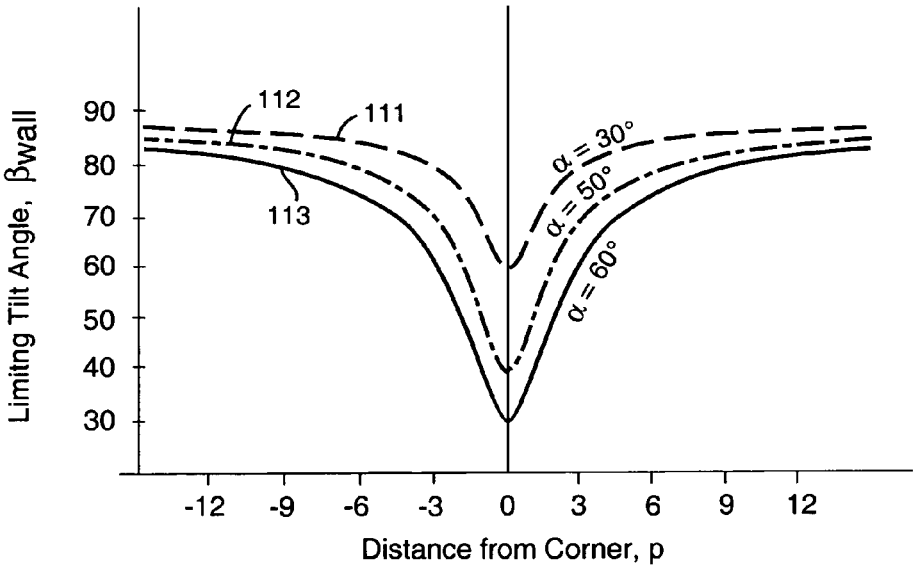
FIG. 10 is a graph showing the limiting tilt angle of the motion detector head as a function of its mounting position on a wall for several different conical downward patterns.

FIG. 10 shows the dependency of the limiting angle $\beta$ wall on the distance p from the edge of the wall for breaking detection zones of several polar angles $\alpha$. For the curve 111 the breaking detection zone has a polar angle of 30°; i.e., the zone dips down by 60° when the head is level. For this angle the motion detector head can be mounted right at the edge of the wall (p equal to zero), and the head can be rotated down through a full 60° range without the breaking detection zone being turned skyward. This is the case, for example, with a downward conical zonal pattern as in the embodiment of FIGS. 3A and 3B with a cone half-angle of $\alpha$ equal to 30° or with a downward curtain zonal pattern as in the embodiment of FIG. 5 where the curtain has a depth (i.e., a thickness) such that the break-away zone has a polar angle of 30°. A motion detector with such a zonal pattern has the advantage that it may be mounted at any distance from the wall's edge and the head may be tilted through the full practical range of 60°. Such a motion detector may even be mounted at the corner of the wall angled at 45° to the wall so as to monitor both sides of the corner without sacrificing the ability to tilt the head through the full 60°. Thus, a motion detector with downward-looking zones forming a generally circular conical zonal pattern with cone half-angle $\alpha$ of 30° (i.e., a full angle of 60° at the apex of the conical pattern) provides a motion-activated light fixture of widespread applicability in most if not all practical installation geometries, in which the motion detector head may be tilted through a practical range of about 60° for aiming the far forward zones without any of the downward/backward zones being turned skyward.

For the curve 112 the breaking detection zone has a polar angle of 50°; i.e., the zone dips down by 40°. A motion detector defining such a breaking detection zone still has widespread applicability and can be mounted reasonably near the edge of the wall. For example, if the motion detector head is mounted at a distance p equal to 1.8 from the corner of the wall, the head may still be tilted through a full practical 60°. As a general rule, the ability to tilt the head through 45° is sufficient for a great majority of installations. Here the head can safely be tilted through 45° if the motion detector is mounted as close as a distance p equal to 0.65 from the corner. The precise distance that the head is spaced out from the wall depends on the design of the particular embodiment of motion detector head and mounting arrangement as well as whether the base plate is mounted directly on the wall or on a fascia board. Nevertheless, a typical spacing is about one foot. Thus, for the arrangement of curve 112, the motion detector can be mounted at about eight inches from the edge of the wall and still permit movement of the head down through 45° without generating a skyward zone. Thus, this embodiment provides a favorable balance between the desirable ability to adjust the forward range of the motion detector far zones and undesirable escalation of false activations through skyward backward zones that is suitable for a great majority of installations.

For the curve 113 the breaking detection zone has a polar angle of 60°; i.e., the zone dips down by 30°. This configuration corresponds to a very wide-angle downward zonal pattern. It may be achieved, for example, by a conical downward zonal pattern with a cone half-angle of 60° or by a deep curtain pattern reaching back 60° from the forward-back demarcation. Here the motion detector may be mounted at a distance from the corner with p equal to 1.4, which corresponds to about one foot five inches with a one foot spacing from the wall, and the head may still be tilted through 45° before an unblocked zone is turned skyward. This arrangement provides an embodiment with particularly wide-angle coverage of the close-in and near intermediate regions behind and in front of the motion detector while still offering a significant freedom to aim the head without turning the backward zones so far upward as to heighten susceptibility to false activations.

For those embodiments in which the backward-monitoring zones are initially aimed forward by an offset angle and not brought into their backward-monitoring disposition until the head is tilted downward by a predetermined initial angle, the offset angle can also be expressed in terms of the directional angles for the zone. By offset angle of a zone is meant the angle through which the head must be tilted down to bring the initial forward-looking zone to the vertical demarcation plane between forward and back. Any greater tilt of the head turns the zone backward. The derivation of the relationship proceeds quite analogously to that for Eq. (3). The result is $$\cot\beta_{offset} = \frac{\cot\varphi}{\sin\gamma}. \tag{18}$$

Here $\beta_{offset}$ is the angle of tilt of the head as just described and is also equal to the angle between the vertical and the projection of the zone direction vector onto the yz plane. The angle $\phi$ is the polar angle of the detection zone as before. The angle $\gamma$ is the azimuth of the detection zone, but now measured toward the forward direction instead of the backward direction as in FIG. 8. Thus, for example, for a detection zone angled down with a polar angle of 60° (a dip angle of 30°) the zone must be angled forward by about 8° to have an offset angle of about 14°. Tilting the head down by greater than 14° will bring this zone into backward-monitoring disposition.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims.

What is claimed is:

1. A motion-activated lighting fixture including an aimable PIR motion detector, the motion detector including a housing having a generally forward looking window, the motion detector being structured and arranged to define a first plurality of infra-red detection zones directed through said generally forward looking window, detection zones of said first plurality forming a first zonal pattern extending in the generally forward direction and arranged for monitoring a far field at a far level of vision, and the housing being movably mounted on a base member so as to permit the far field to be aimed at various positions closer and farther away, wherein the improvement is characterized in that:

said housing has a generally horizontal downward looking window disposed at the underside of said housing and includes an optical arrangement focusing infra-red energy from a second plurality of detection zones through said downward looking window, said second plurality of detection zones forming a second zonal pattern for monitoring a field behind and underneath said motion detector housing, the zones of said second zonal pattern being angulated and disposed with respect to said far level of vision such that one or more of the zones of said second zonal pattern will be in disposition for monitoring the field behind said motion detector housing when said far field is aimed at said various positions.

2. The apparatus of claim 1, further characterized in that the zones of said first and second pluralities are arranged such that the field behind said motion detector housing is monitored entirely by zones of said second zonal pattern.

3. The apparatus of claim 1, further characterized in that detection zones of said first plurality form a further zonal pattern extending in the generally forward direction and arranged for monitoring intermediate fields not so distant as said far field.

4. The apparatus of claim 1, further characterized in that said motion detector comprises at least one forward sensor and at least one downward sensor, and said motion detector is structured and arranged to focus infra-red energy from said first plurality of detection zones through said generally forward looking window onto said at least one forward sensor and to focus infra-red energy from said second plurality of detection zones through said generally downward looking window onto said at least one downward sensor.

5. The apparatus of claim 4, further characterized in that said motion detector comprises a single downward looking sensor and a downward looking segmented Fresnel lens member disposed to direct infra-red energy onto said single downward looking sensor.

6. The apparatus of claim 5, wherein said segmented Fresnel lens member defines said second zonal pattern in the form of a generally conical shape.

7. The apparatus of claim 6 wherein said single downward looking sensor is disposed to look in a substantially vertical downward direction when said housing is level and said segmented Fresnel lens is disposed such that the central axis of said generally conical shape lies along said substantially vertical downward direction.

8. The apparatus of claim 6, further characterized in that said motion detector comprises two forward looking sensors angled toward opposite sides of the straight ahead direction.

9. The apparatus of claim 1, wherein said second zonal pattern is generally conically shaped.

10. The apparatus of claim 1, wherein said second zonal pattern is generally conically shaped.

11. The apparatus of claim 1, further characterized in that said motion detector includes one and only one sensor and said motion detector is structured and arranged to focus infra-red energy from said first plurality of detection zones through said generally forward looking window onto said sensor and from said second plurality of detection zones through said generally downward looking window onto said sensor.

12. The apparatus of claim 11, further characterized in that said motion detector includes a segmented Fresnel lens member disposed in said generally downward looking window and formed to define said second zonal pattern in the form of a curtain pattern.

13. The apparatus of claim 1, wherein at least some of the detection zones of said second zonal pattern are arranged so as to extend in the backward direction when said motion detector housing is horizontal.

14. The apparatus of claim 1, further characterized in that said second zonal pattern is arranged such that detection zones of said second zonal pattern extend backward only when said motion detector housing is aimed below horizontal by an angle greater than a characteristic angle.

15. The apparatus of claim 14 wherein said characteristic angle is at least as great as 14 degrees.

16. The apparatus of claim 1 wherein said second plurality of detection zones forms a dense zonal pattern for dense coverage of the region behind and under said motion detector.

17. The apparatus of claim 16 wherein said second plurality of detection zones has a density of at least one level of vision per twelve degrees of forward-back coverage.

18. A motion-activated lighting fixture including an aimable PIR motion detector structured and arranged to define a plurality of infra-red detection zones, a first group of the detection zones forming a first zonal pattern disposed for monitoring a far field, the housing being movably mounted on a base member so as to permit the far field to be aimed at various positions closer and farther away, wherein the improvement is characterized in that:

the detection zones of said first group are confined substantially to the forward direction; and said plurality of detection zones includes a plurality of backward directed detection zones angulated with respect to said first zonal pattern to extend in the downward and backward direction when said far field is aimed at said various positions, wherein the direction of each said backward directed detection zone is characterized by a dip angle $\phi_{dip}$, and azimuth $\theta$ determined when said housing is level, and said plurality of backward directed detection zones has no detection zones with a dip angle of less than $\phi_{limit}$, determined by the relation $$\tan \phi_{limit} = \sin \theta \tan 60°.$$

19. The apparatus of claim 18 wherein $\phi_{limit}$ is determined by the relation $$\tan \phi_{limit} = \sin \theta \tan 50°.$$

20. The apparatus of claim 18 wherein $\phi_{limit}$ is determined by the relation $$\tan \phi_{limit} = \sin \theta \tan 30°.$$

21. The apparatus of claim 20 wherein said second plurality of detection zones has a density of at least one level of vision per twelve degrees of forward-back coverage.

22. A motion-activated lighting fixture including an aimable PIR motion detector, the motion detector including a housing having a generally forward looking window, the motion detector being structured and arranged to define a first plurality of infra-red detection zones directed through said generally forward looking window, detection zones of said first plurality forming a first zonal pattern extending in the generally forward direction and arranged for monitoring a far field at a far level of vision, and the housing being movably mounted on a base member so as to permit the far field to be aimed at various positions closer and farther away, wherein the improvement is characterized in that:

said housing has a generally horizontal downward looking window disposed at the underside of said housing and includes an optical arrangement focusing infra-red energy from a second plurality of detection zones through said downward looking window, said second plurality of detection zones forming a second zonal pattern for monitoring a field behind and under said motion detector housing, wherein the zones of said second zonal pattern are disposed to angle forward when said housing is in horizontal disposition, and one or more of said zones is angled forward by a least offset angle, said least offset angle being sized such that said zones at said least offset angle will be brought into backward-monitoring disposition when said motion detector housing is tilted downward by an angle at least as great as said least offset angle for aiming said far field.

23. A motion-activated lighting fixture including an aimable PIR motion detector, the motion detector including a housing movably mounted on a base member so as to permit the motion detector to be aimed in a desired direction, wherein the motion detector comprises:

a generally forward looking window;

a first support structure within said housing and one or more sensors mounted on said first support structure;

a first optical arrangement structured and arranged to focus infra-red energy through said generally forward looking window onto said one or more sensors, said first optical arrangement and said sensors being disposed to define a first plurality of detection zones wherein at least some of the detection zones of said first plurality form a first zonal pattern extending in the generally forward direction and arranged for monitoring a far field at a far level of vision;

a generally downward looking window formed at the underside of said housing;

a second support structure within said housing and a generally downward looking sensor mounted on said second support structure;

a second optical arrangement structured and arranged to focus infra-red energy through said generally downward looking window onto said downward looking sensor, said second optical arrangement and said downward looking sensor being disposed to define a second plurality of detection zones, wherein the zones of said second plurality are disposed to provide coverage of a region behind and under said motion detector when said housing is moved to aim said far field at a practical range of positions closer and farther away.

24. The apparatus of claim 23 wherein said motion detector comprises a pair of sensors mounted on said first support structure, the sensors of said pair being aimed generally forward and angled toward opposite sides.

25. The apparatus of claim 23 wherein said second optical arrangement defines one or more focal lengths shorter than focal lengths of said first optical arrangement.

26. The apparatus of claim 23 wherein said first optical arrangement comprises one or more first segmented Fresnel lens members disposed to focus infra-red energy onto said one or more sensors, and said second optical arrangement comprises a second segmented Fresnel lens member disposed to focus infra-red energy onto said downward looking sensor.

27. The apparatus of claim 26 wherein said second segmented Fresnel lens member is disposed closer to said downward looking sensor than said one or more first Fresnel lens members are to said one or more forward looking sensors, thereby to facilitate shorter focal lengths for said second Fresnel lens member, whereby said second plurality of detection zones is better adapted for close-in monitoring.

* * * * *